US005611531A

United States Patent [19]

Skerlan

[11] Patent Number: 5,611,531

[45] Date of Patent: Mar. 18, 1997

[54] PRO PITCHING DEVICE

[76] Inventor: Jim Skerlan, 1 Skyline Drive, Dundas, Ontario, Canada, L9H 3S3

[21] Appl. No.: 667,392

[22] Filed: Jun. 21, 1996

[51] Int. Cl.[6] ..... A63B 69/00

[52] U.S. Cl. ..... 473/454; 273/402; 273/394; 273/389; 473/481

[58] Field of Search ..... 273/26 A, 1.5 A, 273/181 D, 181 F, 394–396, 397, 402, 29 A, 363, 365, 378, 379, 382, 383, 385, 389, 390

[56] References Cited

U.S. PATENT DOCUMENTS

| | | | |
|---|---|---|---|
| 1,142,184 | 6/1915 | Lawrence | 273/26 A |
| 3,233,896 | 2/1966 | King | 273/1.5 A |
| 3,810,616 | 5/1974 | Murphy | 273/26 A |
| 4,118,028 | 10/1978 | Larkin | 273/26 A |
| 4,160,549 | 7/1979 | Simpson | 273/29 A |
| 4,188,031 | 2/1980 | Fox | 273/26 A |
| 4,254,952 | 3/1981 | Playter | 273/26 A |
| 4,592,547 | 6/1986 | Thaxton | 273/394 |
| 4,949,979 | 8/1990 | Wheatcroft | 273/389 |
| 5,351,948 | 10/1994 | Thomas | 273/26 A |
| 5,505,443 | 4/1996 | Padilla | 273/26 A |

OTHER PUBLICATIONS

CLEO Learners Aids, p. 14, Feb. 28, 1976.

*Primary Examiner*—Theatrice Brown
*Attorney, Agent, or Firm*—Michael I. Kroll

[57] ABSTRACT

A pro pitching device (10) comprising a backboard target (12) having a bull's-eye central aperture (14). An assembly (16) is for elevating the backboard target (12) in an adjustable vertical position above the ground (18). A person (20) can stand at a distance away from the backboard target (12) and throw a ball (22) towards the backboard target (12) and into the bull's-eye central aperture (14). A facility (24) is for stopping the ball (22) after entering the bull's-eye central aperture (14) and allowing the ball (22) to fall gently to the ground (18).

18 Claims, 3 Drawing Sheets

PRO PITCHING DEVICE

BACKGROUND OF THE INVENTION

1. Field of the Invention

The instant invention relates generally to self-practice equipment for ball sports and more specifically it relates to a pro pitching device.

2. Description of the Prior Art

Numerous self-practice equipment for ball sports have been provided in prior art that are adapted to help players to improve their aim when they throw balls into the equipment. While these units may be suitable for the particular purpose to which they address, they would not be as suitable for the purposes of the present invention as heretofore described.

SUMMARY OF THE INVENTION

A primary object of the present invention is to provide a pro pitching device that will overcome the shortcomings of the prior art devices.

Another object is to provide a pro pitching device that will help develop a person to accurately pitch a ball into a bull's-eye being a central aperture in a vertically elevated backboard target.

An additional object is to provide a pro pitching device with an elongated catcher net attached to the rear of the backboard target about the bull's-eye central aperture, to stop and gently drop the ball to the ground.

A further object is to provide a pro pitching device that is simple and easy to use.

A still further object is to provide a pro pitching device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
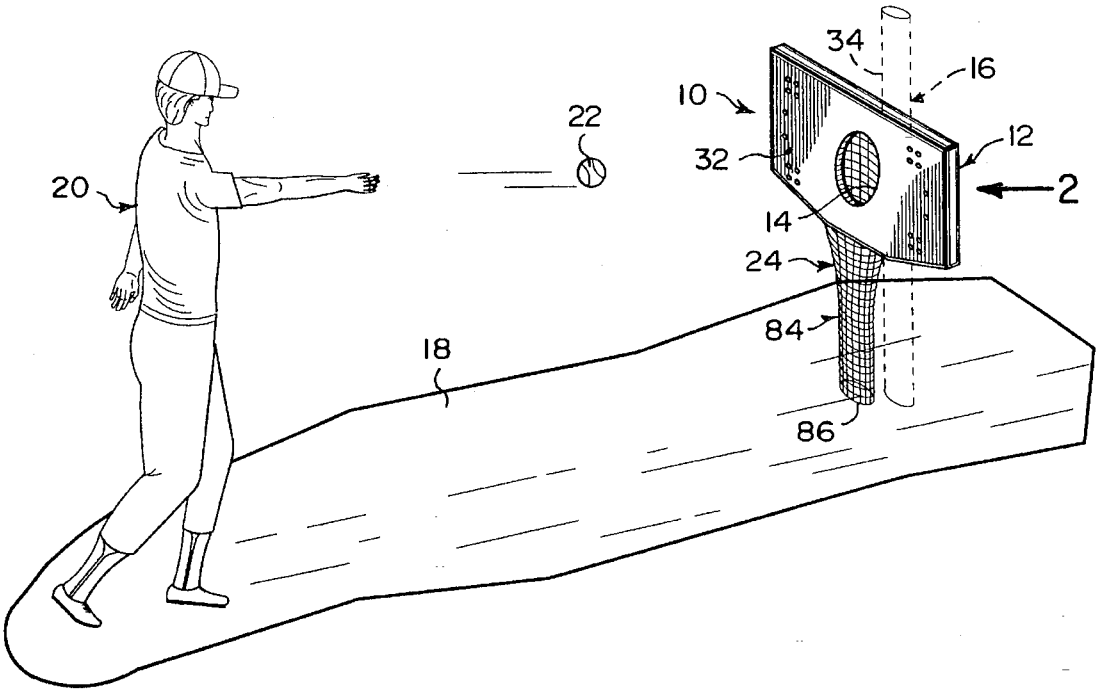
FIG. 1 is a perspective view of the invention in use.
Figure 2:
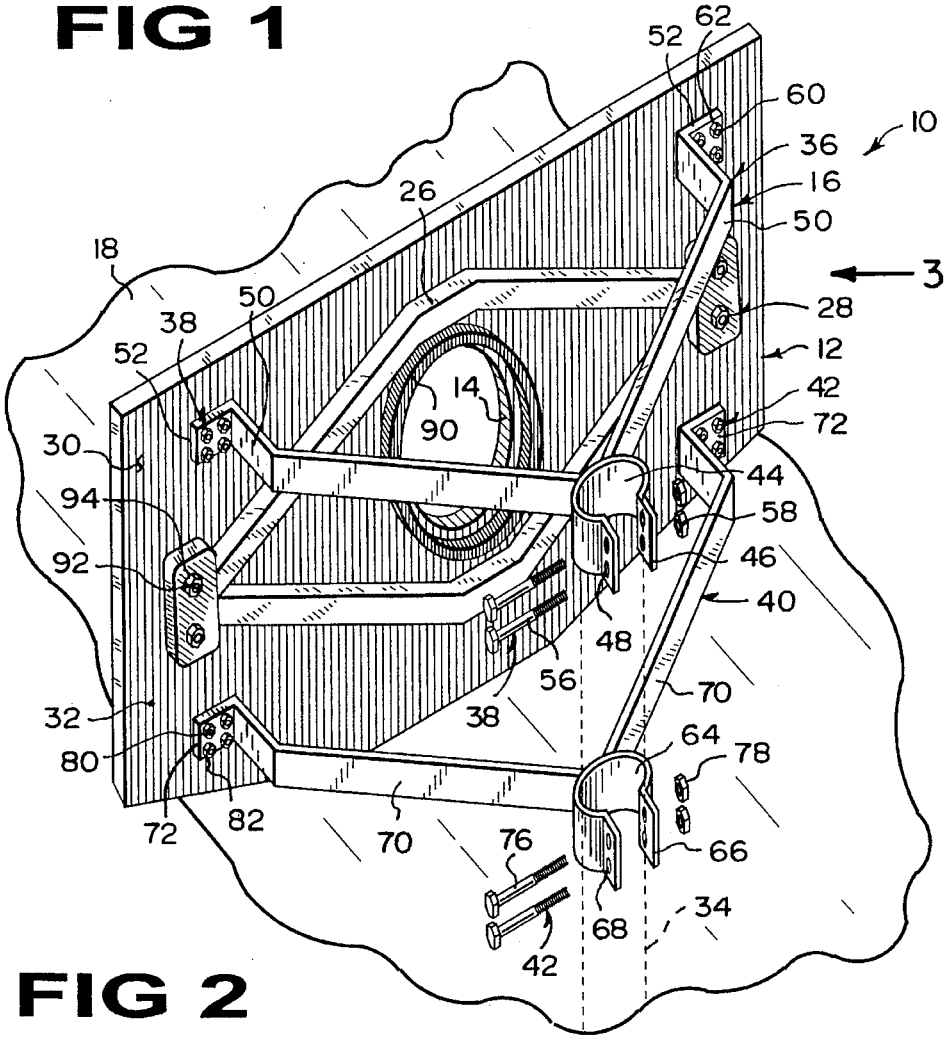
FIG. 2 is a rear perspective view taken in the direction of arrow 2 in FIG. 1, with the catcher net removed therefrom.
Figure 3:
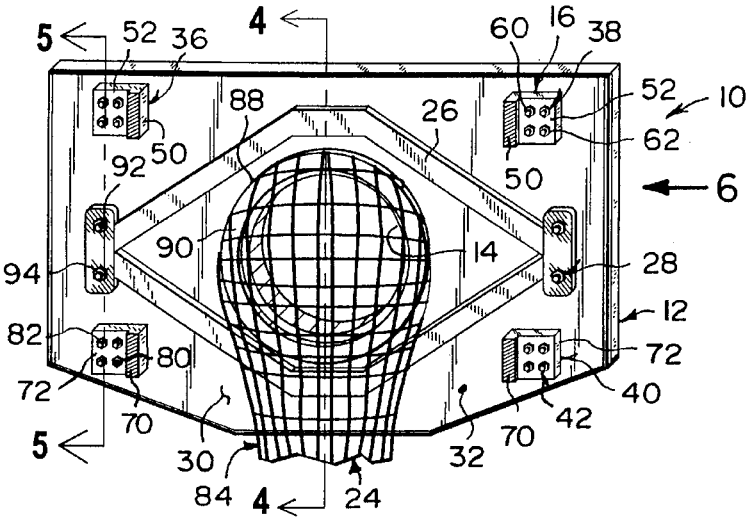
FIG. 3 is a rear perspective view taken in the direction of arrow 3 in FIG. 2, with the upper and lower brackets broken away and the catcher net partly shown.
Figure 4:
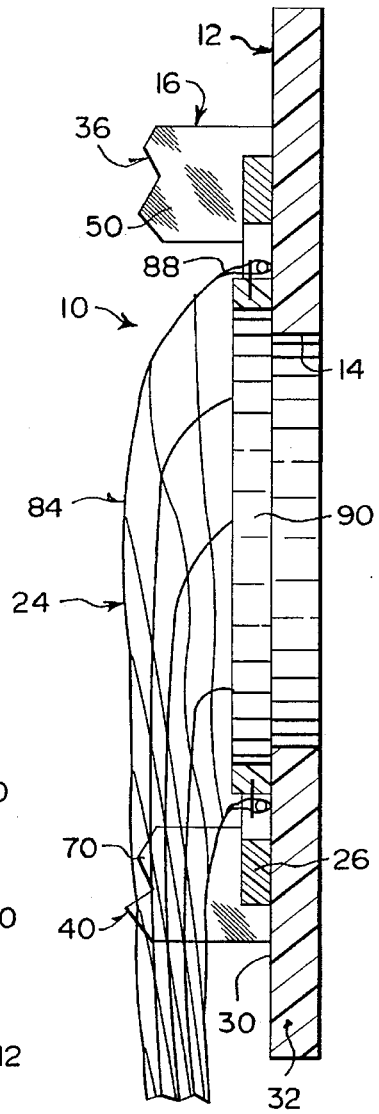
FIG. 4 is a cross sectional view taken along line 4—4 in FIG. 3.
Figure 6:
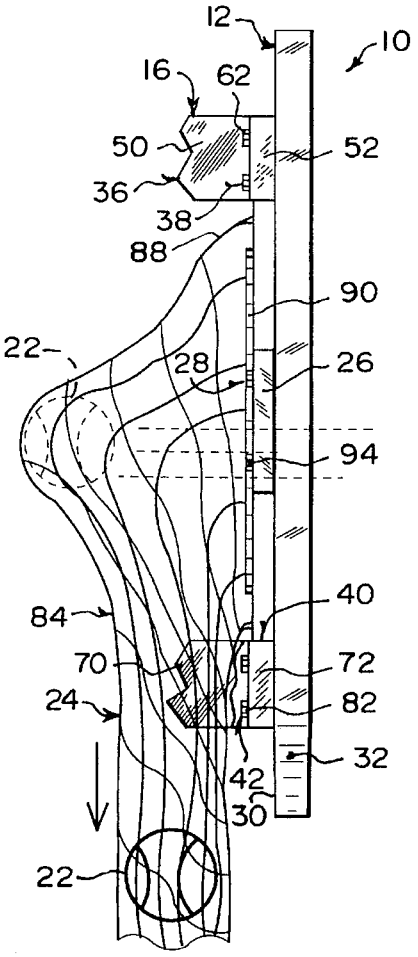
FIG. 6 is a side view taken in the direction of arrow 6 in FIG. 3.
Figure 5:
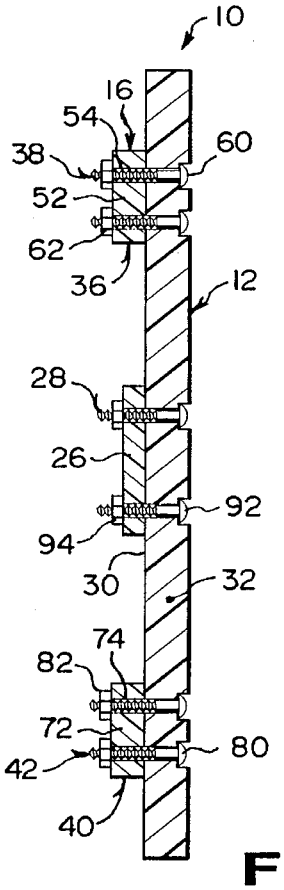
FIG. 5 is a cross sectional view taken along line 5—5 in FIG. 3.

Turning now descriptively to the drawings, in which similar reference characters denote similar elements throughout the several views, FIGS. 1 through 9 illustrate a pro pitching device 10 comprising a backboard target 12 having a bull's-eye central aperture 14. An assembly 16 is for elevating the backboard target 12 in an adjustable vertical position above the ground 18. A person 20 can stand at a distance away from the backboard target 12 and throw a ball 22 towards the backboard target 12 and into the bull's-eye central aperture 14. A facility 24 is for stopping the ball 22 after entering the bull's-eye central aperture 14 and allowing the ball 22 to fall gently to the ground 18.

The pro pitching device 10 further includes a diamond shaped brace member 26. Components 28 are for attaching the diamond shaped brace member 26 to a rear surface 30 of the backboard target 12, to add additional strength to the backboard target 12. The backboard target 12 is fabricated out of a high impact material 32 that is selected from the group consisting of plastic, fiberglass, acrylic, metal and wood.

The elevating assembly 16 consists of a pole 34 inserted vertically into the ground 18. An upper bracket 36 is provided. Elements 38 are for affixing the upper bracket 36 between the rear surface 30 of the backboard target 12 and the pole 34. A lower bracket 40 is also provided. Elements 42 are for affixing the lower bracket 40 between the rear surface 30 of the backboard target 12 and the pole 34.

The upper bracket 36 comprises an upper collar clamp 44 to fit onto the pole 34. The upper collar clamp 44 has a pair of flanges 46 with an aperture 48 through each flange 46. A pair of upper arms 50 extend outwardly at an angle away from the upper collar clamp 44. The pair of upper arms 50 each have a bent free end 52 with a plurality of mounting holes 54 therethrough.

The upper affixing element 38 includes an upper clamp bolt 56 to extend through the apertures 48 in the flanges 46 of the upper collar clamp 44. An upper clamp nut 58 threads onto a threaded shank of the upper clamp bolt 56, to secure the upper collar clamp 44 onto the pole 34. A plurality of upper arm bolts 60 are provided. Each upper arm bolt 60 extends through the backboard target 12 and one of the mounting holes 54 in the pair of upper arms 50. A plurality of upper arm nuts 62 are also provided. Each upper arm nut 62 threads onto a threaded shank of each upper arm bolt 60, to secure the upper bracket 36 to the backboard target 12.

The lower bracket 40 consists of a lower collar clamp 64 to fit onto the pole 34. The lower collar clamp 64 has a pair of flanges 66 with an aperture 68 through each flange 66. A pair of lower arms 70 extend outwardly at an angle away from the lower collar clamp 64. The pair of lower arms 70 each have a bent free end 72 with a plurality of mounting holes 74 therethrough.

The lower affixing elements 42 include a lower clamp bolt 76 to extend through the apertures 68 in the flanges 66 of the lower collar clamp 64. A lower clamp nut 78 threads onto a threaded shank of the lower clamp bolt 76, to secure the lower collar clamp 64 onto the pole 34. A plurality of lower arm bolts 80 are provided. Each lower arm bolt 80 extends through the backboard target 12 and one of the mounting holes 74 in the pair of lower arms 70. A plurality of lower arm nuts 82 are also provided. Each lower arm nut 82 threads onto a threaded shank of each lower arm bolt 80, to secure the lower bracket 40 to the backboard target 12.

The ball stopping facility 24 consists of an elongated funnel shaped catcher net 84, having an open narrow bottom end 86 and a wide top end 88. A collar 90 is affixed to the rear surface 30 of the backboard target 12 about the bull's-eye central aperture 14. The wide top end 88 of the catcher net 84 can be attached to the collar 90 with the catcher net 84 hanging down and the narrow bottom end 88 slightly above the ground 18, to allow the ball 22 to exit therefrom.

The brace member attaching components 28 comprise a plurality of brace member bolts 92. Each brace member bolt 92 extends through the backboard target 12 and one side end of the diamond shaped brace member 26. A plurality of brace member nuts 94 are provided. Each brace member nut 94 threads onto a threaded shank of each brace member bolt 92, to secure the diamond shaped brace member 26 to the backboard target 12.

Figure 7:
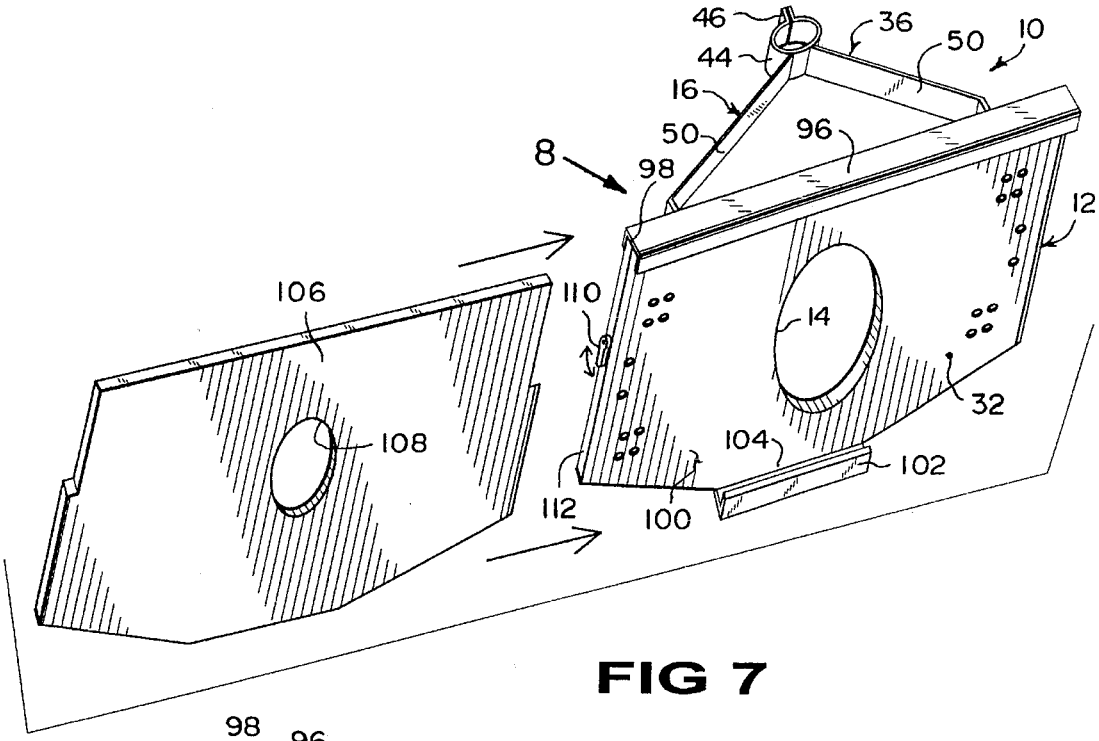
FIG. 7 is a perspective view of a second embodiment, showing an insert plate with a smaller bull's-eye aperture ready to be inserted into upper and lower tracks on the backboard target and the catcher net removed therefrom.
Figure 9:
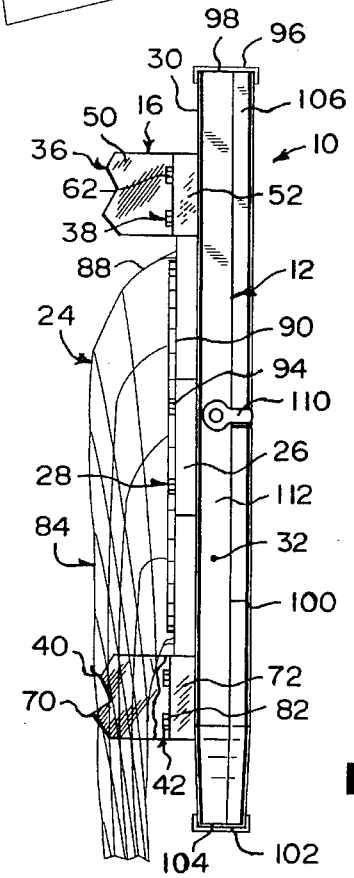
FIG. 9 is a side view taken in the direction of arrow 9 in FIG. 8.
Figure 8:
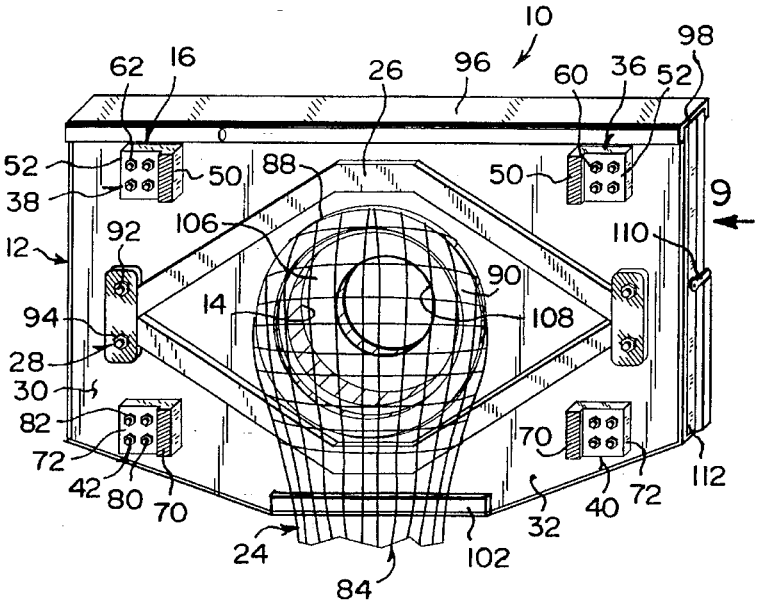
FIG. 8 is a rear perspective view taken in the direction of arrow 8 in FIG. 7, with the insert plate in place, the upper and lower brackets broken away and the catcher net partly shown.

The pro pitching device, as shown in FIGS. 7 through 9, further includes an upper channel track 96, U-shaped in cross section, affixed to an upper horizontal edge 98 of the backboard target 12. The upper channel track 96 overhangs a front surface 100 of the backboard target 12. A lower channel track 102, U-shaped in cross section, is affixed to a lower horizontal edge 104 of the backboard target 12. The lower channel track 102 overhangs the front surface 100 of the backboard target 12. A target plate 106 is provided, having a smaller bull's-eye central aperture 108. The target plate 106 is insertable between the upper channel track 96 and the lower channel track 102, so as to fit in front of the backboard target 12. A latch mechanism 110 is on each of the vertical side edges 112 of the backboard target 12, so as to hold the target plate 106 in place in front of the backboard target 12.

LIST OF REFERENCE NUMBERS

10 pro pitching device
12 backboard target of 10
14 bull's-eye central aperture in 12
16 elevating assembly of 10
18 ground
20 person
22 ball
24 ball stopping facility of 10
26 diamond shaped brace member of 10
28 brace member attaching components of 10
30 rear surface of 12
32 high impact material for 12
34 pole of 16
36 upper bracket of 16
38 upper affixing elements of 16
40 lower bracket of 16
42 lower affixing elements of 16
44 upper collar clamp of 36
46 flange on 44
48 aperture in 46
50 upper arm of 36
52 bent free end of 50
54 mounting hole in 52
56 upper clamp bolt of 38
58 upper clamp nut of 38
60 upper arm bolt of 38
62 upper arm nut of 38
64 lower collar clamp of 40
66 flange on 64
68 aperture in 66
70 lower arm of 40
72 bent free end of 70
74 mounting hole in 72
76 lower clamp bolt of 42
78 lower clamp nut of 42
80 lower arm bolt of 42
82 lower arm nut of 42
84 elongated funnel shaped catcher net of 24
86 open narrow bottom end of 84
88 wide top end of 84
90 collar of 24
92 brace member bolt of 28
94 brace member nut of 28
96 upper channel track
98 upper horizontal edge of 12
100 front surface of 12
102 lower channel track
104 lower horizontal edge of 12
106 target plate
108 smaller bull's-eye central aperture in 106
110 latch mechanism
112 vertical side edge of 12

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A practice target device comprising:

a) a backboard target having a bull's-eye central aperture;

b) means for elevating said backboard target in an adjustable vertical position above the ground, so that a person can stand at a distance away from said backboard target and throw a ball towards said backboard target and into said bull's-eye central aperture;

c) means for stopping the ball after entering said bull's-eye central aperture and allow the ball to fall gently to the ground;

d) a diamond shaped brace member; and e) means for attaching said diamond shaped brace member to a rear surface of said backboard target, to add additional strength to said backboard target.

2. A practice target pitching device as recited in claim 1, wherein said backboard target is fabricated out of a high impact material that is selected from the group consisting of plastic, fiberglass, acrylic, metal and wood.

3. A practice target pitching device as recited in claim 1, wherein said elevating means includes:

a) a pole inserted vertically into the ground;

b) an upper bracket;

c) means for affixing said upper bracket between a rear surface of said backboard target and said pole;

d) a lower bracket; and e) means for affixing said lower bracket between the rear surface of said backboard target and said pole.

4. A practice target pitching device as recited in claim 3, wherein said upper bracket includes:

a) an upper collar clamp to fit onto said pole, wherein said upper collar clamp having a pair of flanges with an aperture through each said flange; and b) a pair of upper arms extending outwardly at an angle away from said upper collar clamp, wherein said pair of upper arms each having a bent free end with a plurality of mounting holes therethrough.

5. A practice target pitching device as recited in claim 4, wherein said upper affixing means includes:

a) an upper clamp bolt to extend through said apertures in said flanges of said upper collar clamp;

b) an upper clamp nut to thread onto a threaded shank of said upper clamp bolt, to secure said upper collar clamp onto said pole;

c) a plurality of upper arm bolts, wherein each said upper arm bolt extends through said backboard target and one of said mounting holes in said pair of upper arms; and d) a plurality of upper arm nuts, wherein each said upper arm nut threads onto a threaded shank of each said upper arm bolt, to secure said upper bracket to said backboard target.

6. A practice target pitching device as recited in claim 3, wherein said lower bracket includes:

a) a lower collar clamp to fit onto said pole, wherein said lower collar clamp having a pair of flanges with an aperture through each said flange; and b) a pair of lower arms extending outwardly at an angle away from said lower collar clamp, wherein said pair of lower arms each having a bent free end with a plurality of mounting holes therethrough.

7. A practice target pitching device as recited in claim 6, wherein said lower affixing means includes:

a) a lower clamp bolt to extend through said apertures in said flanges of said lower collar clamp;

b) a lower clamp nut to thread onto a threaded shank of said lower clamp bolt, to secure said lower collar clamp onto said pole;

c) a plurality of lower arm bolts, wherein each said lower arm bolt extends through said backboard target and one of said mounting holes in said pair of lower arms; and d) a plurality of lower arm nuts, wherein each said lower arm nut threads onto a threaded shank of each said lower arm bolt, to secure said lower bracket to said backboard target.

8. A practice target pitching device as recited in claim 1, wherein said ball stopping means includes:

a) an elongated funnel shaped catcher net, having an open narrow bottom end and a wide top end; and b) a collar affixed to a rear surface of said backboard target about said bull's-eye central aperture, so that said wide top end of said catcher net can be attached to said collar with said catcher net hanging down and said narrow bottom end slightly above the ground to allow the ball to exit therefrom.

9. A practice target pitching device as recited in claim 1, wherein said brace member attaching means includes:

a) a plurality of brace member bolts, wherein each said brace member bolt extends through said backboard target and one side end of said diamond shaped brace member; and b) a plurality of brace member nuts, wherein each said brace member nut threads onto a threaded shank of each said brace member bolt, to secure said diamond shaped brace member to said backboard target.

10. A practice target pitching device comprising:

a) a backboard target having a bull's-eye central aperture;

b) means for elevating said backboard target in an adjustable vertical position above the ground, so that a person can stand at a distance away from said backboard target and throw a ball towards said backboard target and into said bull's-eye central aperture;

c) means for stopping the ball after entering said bull's-eye central aperture and allow the ball to fall gently to the ground;

d) a diamond shaped brace member;

e) means for attaching said diamond shaped brace member to a rear surface of said backboard target, to add additional strength to said backboard target;

f) an upper channel track U-shaped in cross section, affixed to an upper horizontal edge of said backboard target, so that said upper channel track overhangs a front surface of said backboard target;

g) a lower channel track, U-shaped in cross section, affixed to a lower horizontal edge of said backboard target, so that said lower channel track overhangs the front surface of said backboard target;

h) a target plate having a smaller bull's-eye central aperture, said target plate being insertable between said upper channel track and said lower channel track, so as to fit in front of said backboard target; and i) a latch mechanism on each of the vertical side edges of said backboard target, so as of hold said target plate in place in front of said backboard target.

11. A practice target pitching device as recited in claim 10, wherein said backboard target is fabricated out of a high impact material that is selected from the group consisting of plastic, fiberglass, acrylic, metal and wood.

12. A practice target pitching device as recited in claim 11, wherein said elevating means includes:

a) a pole inserted vertically into the ground;

b) an upper bracket;

c) means for affixing said upper bracket between a rear surface of said backboard target and said pole;

d) a lower bracket; and e) means for affixing said lower bracket between the rear surface of said backboard target and said pole.

13. A practice target pitching device as recited in claim 12, wherein said upper bracket includes:

a) an upper collar clamp to fit onto said pole, wherein said upper collar clamp having a pair of flanges with an aperture through each said flange; and b) a pair of upper arms extending outwardly at an angle away from said upper collar clamp, wherein said pair of upper arms each having a bent free end with a plurality of mounting holes therethrough.

14. A practice target pitching device as recited in claim 13, wherein said upper affixing means includes:

a) an upper clamp bolt to extend through said apertures in said flanges of said upper collar clamp;

b) an upper clamp nut to thread onto a threaded shank of said upper clamp bolt, to secure said upper collar clamp onto said pole;

c) a plurality of upper arm bolts, wherein each said upper arm bolt extends through said backboard target and one of said mounting holes in said pair of upper arms; and d) a plurality of upper arm nuts, wherein each said upper arm nut threads onto a threaded shank of each said upper arm bolt, to secure said upper bracket to said backboard target.

15. A practice target pitching device as recited in claim 14, wherein said lower bracket includes:

a) a lower collar clamp to fit onto said pole, wherein said lower collar clamp having a pair of flanges with an aperture through each said flange; and b) a pair of lower arms extending outwardly at an angle away from said lower collar clamp, wherein said pair of lower arms each having a bent free end with a plurality of mounting holes therethrough.

16. A practice target pitching device as recited in claim 15, wherein said lower affixing means includes:

a) a lower clamp bolt to extend through said apertures in said flanges of said lower collar clamp;

b) a lower clamp nut to thread onto a threaded shank of said lower clamp bolt, to secure said lower collar clamp onto said pole;

c) a plurality of lower arm bolts, wherein each said lower arm bolt extends through said backboard target and one of said mounting holes in said pair of lower arms; and d) a plurality of lower arm nuts, wherein each said lower arm nut threads onto a threaded shank of each said lower arm bolt, to secure said lower bracket to said backboard target.

17. A practice target pitching device as recited in claim 16, wherein said ball stopping means includes:

a) an elongated funnel shaped catcher net, having an open narrow bottom end and a wide top end; and b) a collar affixed to a rear surface of said backboard target about said bull's-eye central aperture, so that said wide top end of said catcher net can be attached to said collar with said catcher net hanging down and said narrow bottom end slightly above the ground to allow the ball to exit therefrom.

18. A practice target pitching device as recited in claim 17, wherein said brace member attaching means includes:

a) a plurality of brace member bolts, wherein each said brace member bolt extends through said backboard target and one side end of said diamond shaped brace member; and b) a plurality of brace member nuts, wherein each said brace member nut threads onto a threaded shank of each said brace member bolt, to secure said diamond shaped brace member to said backboard target.

* * * * *